US005938470A

United States Patent [19]

Kashiyama

[11] Patent Number: 5,938,470

[45] Date of Patent: Aug. 17, 1999

[54] HALF-FITTING PREVENTION CONNECTOR

[75] Inventor: Motohisa Kashiyama, Shizuoka, Japan

[73] Assignee: Yazaki Corporation, Tokyo, Japan

[21] Appl. No.: 08/946,194

[22] Filed: Oct. 7, 1997

[30] Foreign Application Priority Data

Oct. 7, 1996 [JP] Japan ..... 8-266202

[51] Int. Cl.[6] ..... H01R 3/00

[52] U.S. Cl. ..... 439/489; 439/357

[58] Field of Search ..... 439/489, 352, 439/354, 357, 358; 324/538, 761; 403/27; 174/65 SS

[56] References Cited

U.S. PATENT DOCUMENTS

| | | | |
|---|---|---|---|
| 4,412,714 | 11/1983 | Morningstar et al. | 439/352 |
| 4,993,967 | 2/1991 | Matsumoto | 439/489 |
| 5,041,017 | 8/1991 | Nakazato et al. | 439/509 |
| 5,183,410 | 2/1993 | Inaba et al. | 439/489 |
| 5,694,043 | 12/1997 | Kodama | 324/538 |
| 5,749,747 | 5/1998 | Inaba et al. | 439/358 |
| 5,785,546 | 7/1998 | Hamai et al. | 439/354 |
| 5,791,930 | 8/1998 | Tabata et al. | 439/345 |
| 5,807,130 | 9/1998 | Miller et al. | 439/352 |
| 5,848,912 | 12/1998 | Okabe | 439/489 |

*Primary Examiner*—Neil Abrams
*Assistant Examiner*—Michael C. Zarolli
*Attorney, Agent, or Firm*—Sughrue, Mion, Zinn, Macpeak & Seas, PLLC

[57] ABSTRACT

A slider is mounted on a housing of one of male and female connectors to be fitted together, and is urged in one direction by a spring, and flexible arms and a lock arm are formed integrally with this slider. Second engagement projections, formed on a housing of the female connector, push the flexible arms, respectively, and are engaged respectively with the flexible arms when the two connectors are fitted together. A retaining projection for retaining the lock arm is formed on that housing. In a half-fitted condition, the second engagement projections are not engaged respectively with the flexible arms, and the female connector is pushed back by the spring, so that the half-fitted condition can be detected. The lock arm is engaged with the retaining projection, and also the flexible arms are engaged respectively with the second engagement projections, thereby preventing the two connectors from being accidentally disengaged from each other.

6 Claims, 7 Drawing Sheets

HALF-FITTING PREVENTION CONNECTOR

BACKGROUND OF THE INVENTION

1. Field of the Invention

This invention relates to a half-fitting prevention connector in which a condition of half-fitting between a pair of male and female connectors to be fitted and connected together is positively prevented by resiliency of a resilient member mounted on a housing of at least one of the two connectors, and the connector can be easily and positively fitted and disengaged relative to the mating connector.

2. Description of the Related Art

Many electronic devices for various controls are mounted on a current automobile, and naturally many wire harnesses and flat cables are used. Automobiles are used in a severe environment in which the automobile is subjected to vibration and submerging. Therefore, in view of the assembling process and the maintenance, half-fitting prevention connectors with a waterproof function have been used to easily connect and disconnect wires such as wire harnesses.

An example of a conventional half-fitting prevention connector will now be described with reference to FIGS. 7 and 8. A pin-side connector 50 has a plurality of pin contacts 52 arranged therein, and has a pair of mounting flanges 50*a* formed respectively at opposite sides thereof. A socket-side connector 51 has a plurality of socket contacts 53 arranged therein, and wires 53*a* are connected to the socket contacts 53, respectively.

The pin-side connector 50 includes a box-shaped housing 54 having an open front side, and a guide plate 55 for guiding the fitting of the socket-side connector 51 is mounted centrally of the height within the housing 54, and divides the interior of the housing 54 into an upper portion and a lower portion. As shown in FIG. 8, within the housing 54, the pin contacts 52 extend from a rear portion of the housing toward the front side thereof. A notch is formed in a central portion of a top plate 54*b* of the housing 54, and a forwardly-directed engagement piece portion 56 is formed integrally with the top plate 54*b*, and is disposed in this notch. A distal end of the engagement piece portion 56 terminates short of the front edge of the top plate 54*b*, and can be slightly elastically bent outwardly. An inwardly-directed engagement projection 56*a* is formed on the distal end of the engagement piece portion 56.

The socket-side connector 51 includes a box-shaped housing 57, and has such a size as to be fitted into the opening in the housing 54 of the pin-side connector 50. Pin holes 58 for respectively receiving the pin contacts 52, and a slot 59 for receiving the guide plate 55 are provided in the front side of the housing 57.

A movable cover 60 is fitted on the housing 57 for movement back and forth, and covers the housing 57 except front and rear end portions thereof. An opening 61 for receiving the pin-side connector 50 is formed through the movable cover 60. The opening 61 has such a size as to receive opposite side plates 54*a*, the top plate 54*b* and a bottom plate 54*c* of the housing 54, but the distal end of the engagement projection 56*a* of the engagement piece portion 56 abuts against the edge of the opening 61, thereby preventing the housing 54 from being inserted into the opening 61.

A pair of opposed spring receiving portions (not shown) are formed respectively at opposite side portions of the movable cover 60 and hence at opposite side portions of the housing 57, and springs 64 are received respectively in the spring receiving portions as indicated by broken lines in FIG. 7, each of the springs 64 extending in the forward-backward direction. The movable cover 60 is normally urged forward (that is, left in FIG. 7) by the springs 64, and is retained by slots 65, formed through an upper wall of the movable cover 60, and projections 66 formed on the upper surface of the housing 57. An engagement groove 67 is formed in the upper surface of the housing 57, and the engagement projection 56*a* of the engagement piece portion 56 is engaged in the engagement groove 67 when the two connectors are completely connected together. The engagement groove 67 is normally concealed by the movable cover 60, and appears when the movable cover 60 is moved.

When the two connectors 50 and 51 are fitted together, the pin contacts 52 contact the socket contacts 53, respectively, and the engagement projection 56*a* is engaged in the engagement groove 67, as shown in FIG. 8. In this engaged condition, the springs 64 are compressed, and the engagement piece portion 56 is covered by the movable cover 60, so that the engagement projection 56*a* can not be disengaged from the engagement groove 67, thereby positively maintaining the connected condition.

On the other hand, when the completely-fitted condition is not achieved, that is, a half-fitted condition is encountered, the distal end of the engagement piece portion 56 abuts against the edge of the opening 61 in the movable cover 60, and the springs 64 are compressed. Therefore, the movable cover 60 presses the engagement piece portion 56 under the influence of the springs 64, and therefore the two connectors 50 and 51 are urged away from each other, and can not be fitted together at all.

In the above connectors, the half-fitting can be prevented, but when the two connectors are to be fitted together while holding the opposite side surfaces of the movable cover 60 with the hand, the movable cover 60 fails to be moved, so that the fitting can not be achieved, thus inviting a problem that the operability is poor since the applied force can not be effectively used.

Besides, in the completely-fitted condition, the engagement piece portion 56 is not covered by the housing 57, and therefore when an external force acts on the movable cover 60, the movable cover 60 can be easily moved, so that the fitted condition of the connectors can be accidentally released.

Furthermore, when the connectors 50 and 51 are to be disengaged from each other, the housing 54 of the connector 50 is withdrawn while rearwardly moving the movable cover 60 on the connector 51, and therefore this disengagement operation is very difficult and complicated.

SUMMARY OF THE INVENTION

It is an object of this invention to provide a half-fitting prevention connector in which a connector can be positively and easily fitted relative to a mating connector, a half-fitted condition is positively prevented, and a disengagement operation can be effected easily.

In order to achieve the above object, the present invention provides a half-fitting prevention connector wherein a pair of female and male connectors are to be fitted and connected together, and a half-fitted condition of the two connectors is prevented by resiliency of a resilient member mounted on a housing of at least one of the two connectors, comprising: a slider mounted on the housing, the slider being normally urged in one direction by the resiliency of the resilient member, and being moved in a direction opposite to the direction of urging by the resilient member when a mating connector is fitted, and the slider comprising: a lock arm which can be pivotally moved in accordance with the fitting of the mating connector, the lock arm having a retaining portion which is retained by a retaining projection, formed on the mating connector, in accordance with the fitting of the mating connector; and a flexible arm which is flexibly deformed by a first engagement projection formed on the housing, and is engaged with a second engagement projection formed on the mating connector, in accordance with the fitting of the mating connector.

DETAILED DESCRIPTION OF THE PREFERRED EMBODIMENTS

Figure 1:
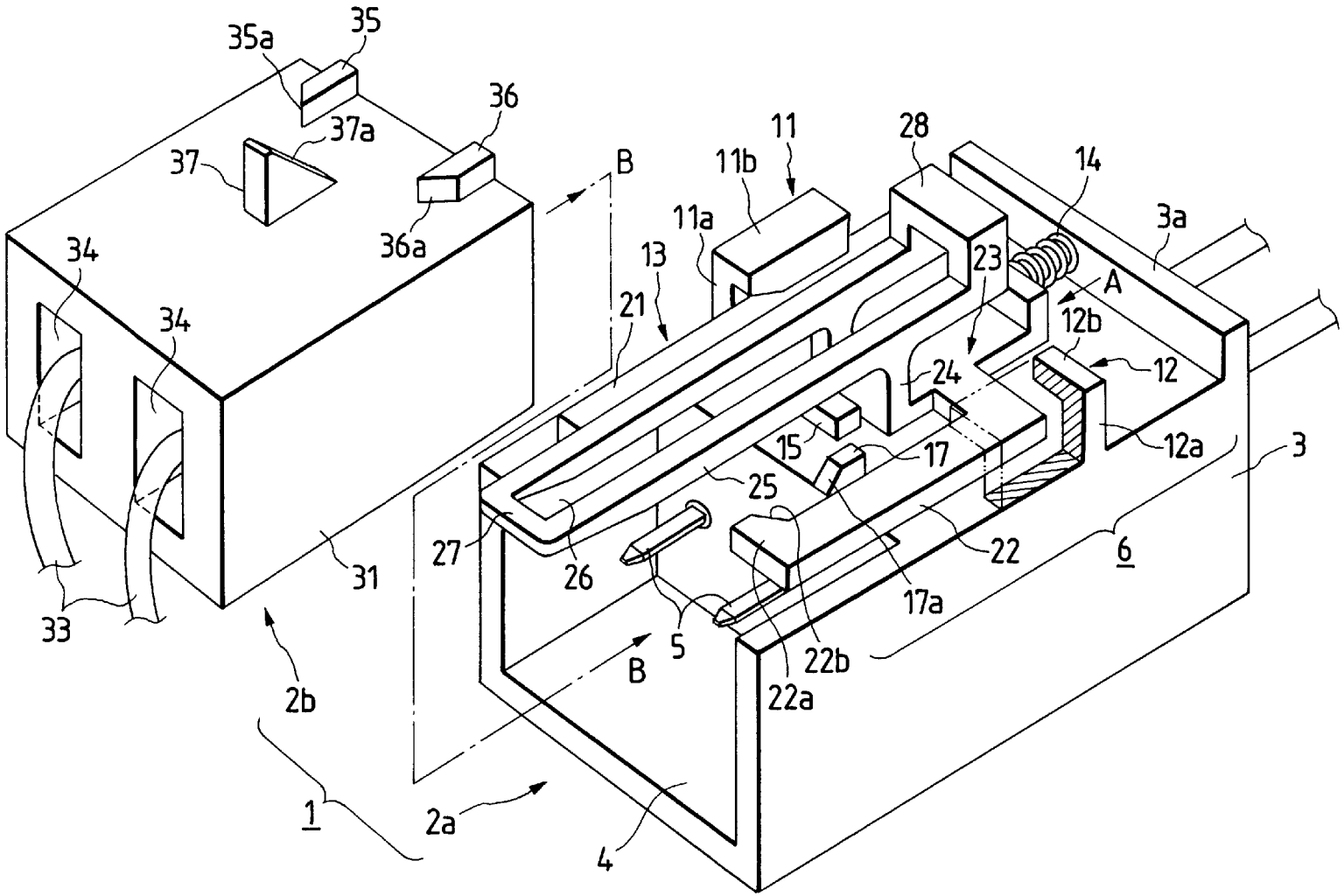
FIG. 1 is a perspective view showing a first embodiment of a half-fitting prevention connector of the present invention.
Figure 2:
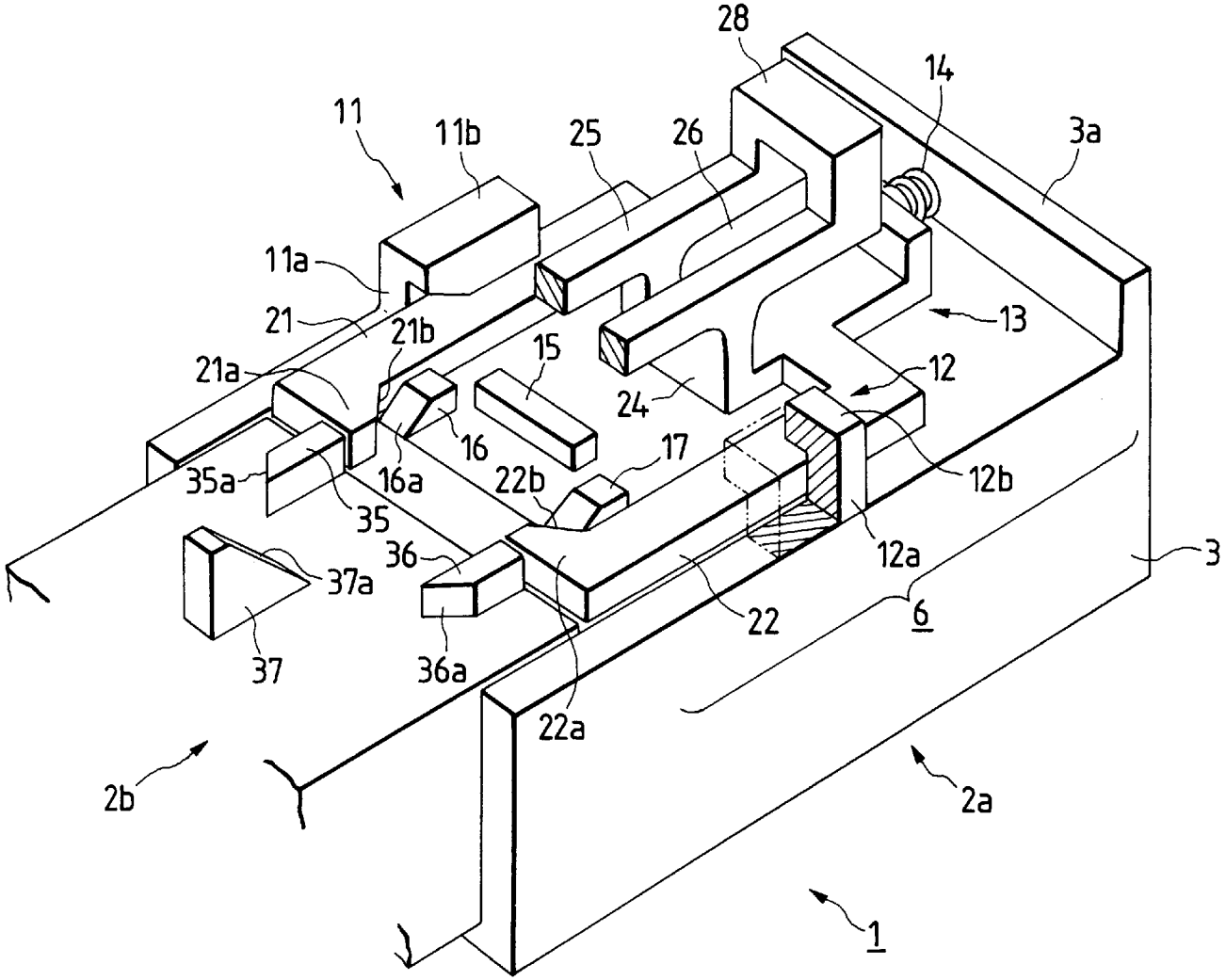
FIG. 2 is a partly-broken, perspective view showing the construction of the connector of FIG. 1 and a fitting operation of the connector.
Figure 3:
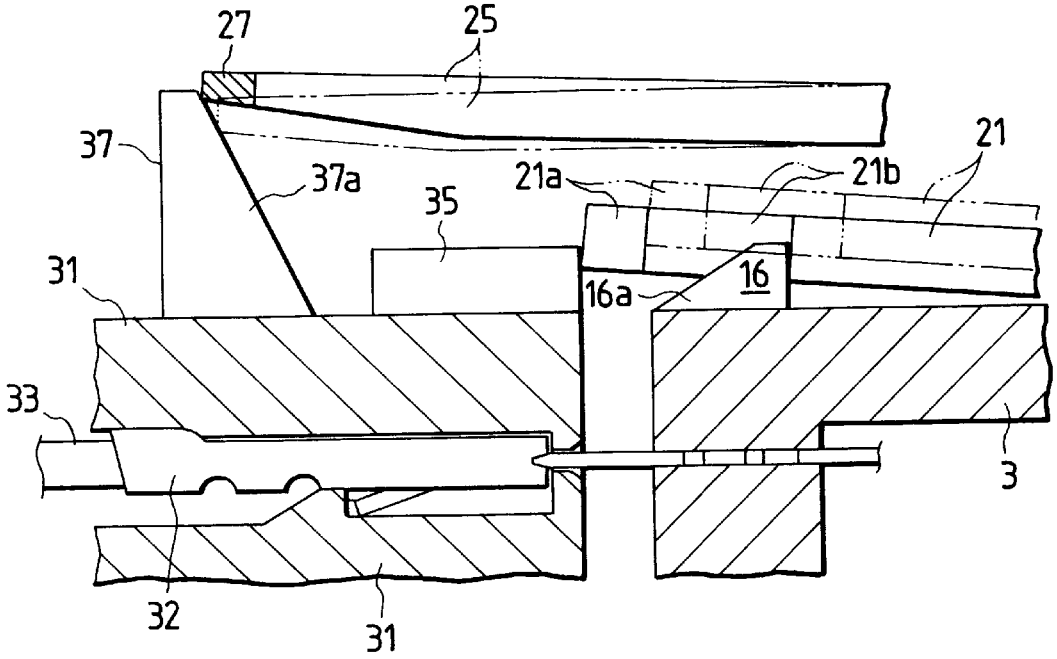
FIG. 3 is a cross-sectional view of an important portion of the connector of FIG. 1, showing the fitting operation of the connector.
Figure 4:
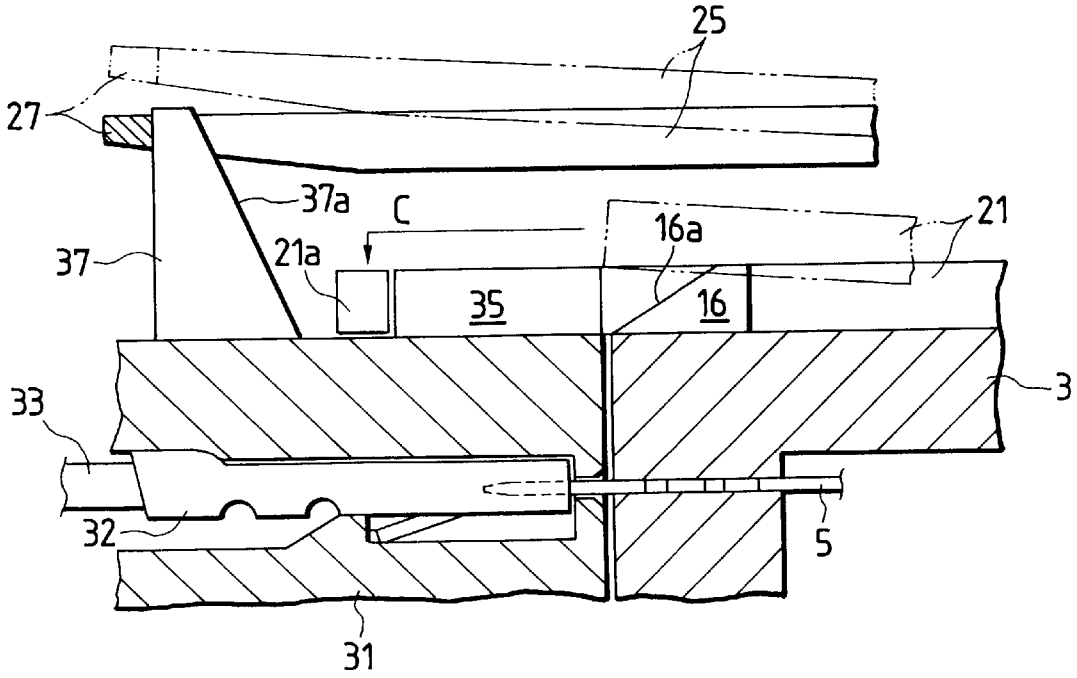
FIG. 4 is a cross-sectional view of an important portion of the connector of FIG. 1, showing the fitting operation of the connector and a completely-fitted condition.
Figure 5:
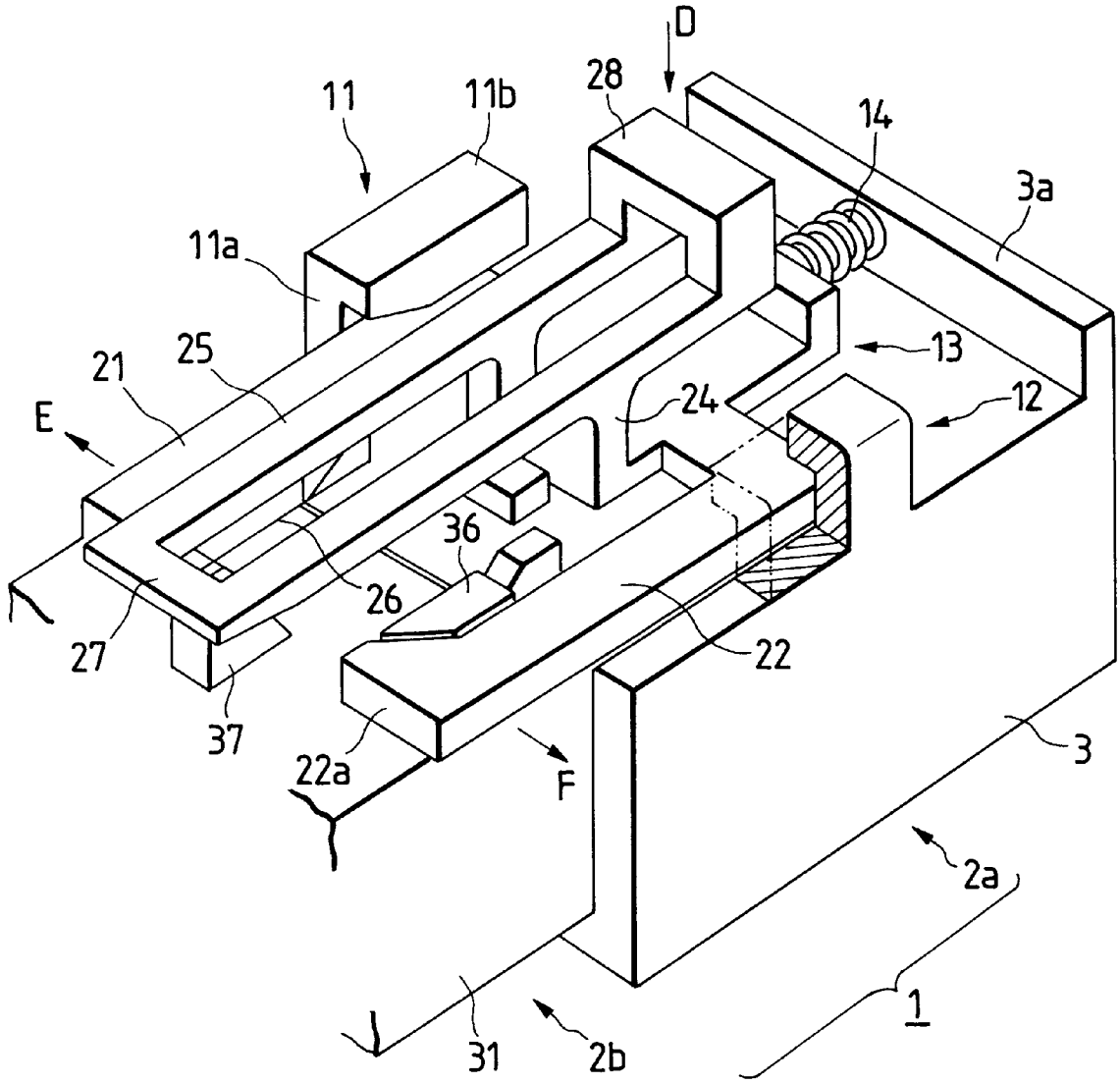
FIG. 5 is a partly-broken, perspective view showing the fitted condition of the connector of FIG. 1.

A first embodiment of a half-fitting prevention connector (hereinafter referred to merely as "connector") of the present invention will now be described with reference to FIGS. 1 to 5. FIG. 1 is a perspective view showing the construction of the connector of the invention, FIG. 2 is a partly-broken, perspective view showing a fitting operation of the connector, FIGS. 3 and 4 are cross-sectional views of an important portion of the connector, showing the fitting operation of the connector, and FIG. 5 is a partly-broken, perspective view showing a fitted condition of the connector. With respect to the explanation of this embodiment, the constructions of male and female connectors will first be described, and then the fitting operation and a fitting release operation will be described.

As shown in FIG. 1, a connector 1 of this embodiment comprises a male connector 2*a* and a female connector 2*b*. The male connector 2*a* broadly comprises a housing 3, male connector terminals 5 which are embedded in this housing 3, and have their one ends projected from a fitting portion 4 formed at a rear end portion of the housing 3, and a lock mechanism 6 provided at an upper portion of the housing 3.

The lock mechanism 6 comprises a pair of guide members 11 and 12 integrally formed respectively on opposite sides of the upper portion of the housing 3, a slider 13 guided by the guide members 11 and 12 for reciprocal movement in directions of the length of the housing 3, a spring (resilient member) 14 normally urging the slider 13 in one direction (in a direction of arrow A), a stopper 15 for positioning the slider 13 at a predetermined position, and first engagement projections 16 and 17 which perform their function at the time of the fitting.

The pair of guide members 11 and 12 are provided for guiding the reciprocal movement of the slider 13, and have an L-shape as shown in a partly-broken manner in FIG. 1. Vertical wall portions 11*a* and 12*a* of the guide members 11 and 12 limit the lateral displacement of the slider 13, and flat plate portions 11*b* and 12*b* limit the vertical displacement of the slider 13.

The slider 13 includes a pair of flexible arms 21 and 22 spaced from each other in a right-left direction, a plate-like connecting portion 23, a support portion 24 extending vertically from one end of the connecting portion 23, and a longitudinal lock arm 25. A retaining hole 26 in the form of a slot is formed through the lock arm 25, and extends centrally of the width thereof, and a front end of the lock arm 25 serves as a retaining portion 27 while a projection, serving as a lock release button 28, is formed at a rear end thereof.

The spring 14 is provided between the rear end of the slider 13 and a wall 3*a* of the housing 3. Therefore, the slider 13 is normally urged in the direction of arrow A, and when the female connector 2*b* is not fitted in the male connector, the support portion 24 is abutted against the stopper 15 as shown in FIG. 1, and also the slider 13 is positioned by the pair of guide members 11 and 12, and therefore the slider 13 will not be moved or displaced vertically and horizontally. However, the slider 13-can be moved in a direction opposite to the direction of arrow A against the bias of the spring 14 as will be described later.

Inwardly-directed engagement pawls 21*a* and 22*a* are formed respectively at distal ends of the flexible arms 21 and 22, and tapered surfaces 21*b* and 22*b* are formed respectively on inner sides of these pawls 21*a* and 22*a*. The engagement pawls 21*a* and 22*a* and the tapered surfaces 21*b* and 22*b* serve to lock the female connector 2*b*, and will be described later in detail in connection with the fitting operation and the lock release operation.

Referring to the female connector 2*b*, female connector terminals 32 (see FIGS. 3 and 4) are embedded in a housing 31, and wires 33, connected respectively to these connector terminals 32, are extended outwardly through outlet ports 34 formed in a rear end of the housing 31.

Second engagement projections 35 and 36 for engagement respectively with the inner sides of the flexible arms 21 and 22 are formed on the upper surface of the housing 31, and a retaining projection 37 for retaining engagement with the retaining portion 27 of the lock arm 25 is also formed on this upper surface.

Tapered surfaces 35*a* and 36*a* are formed respectively at rear ends of the second engagement projections 35 and 36, and the angle of inclination of these tapered surfaces corresponds to the angle of inclination of the tapered surfaces 21*b* and 22*b* formed respectively at the ends of the flexible arms 21 and 22.

A tapered surface 37*a* is formed at the retaining projection 37, and can be brought into smooth sliding contact with the lower side of the rear end of the lock arm 25 when the male connector 2*a* and the female connector 2*b* are fitted together.

Next, the fitting operation with respect to the male and female connectors 2*a* and 2*b*, as well as the half-fitting prevention operation, will be described.

When fitting the female connector 2*b* into the male connector 2*a*, the front end of the female connector 2*b* is inserted into the fitting portion 4 formed in the rear end portion of the male connector 2*a* as indicated by arrow B in FIG. 1. Then, the female connector 2*b* is pushed, or the two connectors are pushed, so that the second engagement projections 35 and 36 are abutted respectively against the rear ends of the flexible arms 21 and 22, as shown in FIG. 2. Then, when the female connector 2*b* is further pushed, the whole of the slider 13 is moved in the direction opposite to the direction of arrow A against the bias of the spring 14.

When the slider 13 continues to be thus moved, inner edges of the engagement pawls 21*a* and 22*a* of the flexible arms 21 and 22 slide respectively over the tapered surfaces 16*a* and 17*a* of the first engagement projections 16 and 17. Referring to the flexible arm 21 and the first engagement projection 16 with reference to FIG. 3, a tapered surface 16*a* is formed on the first engagement projection 16. Therefore, as the slider 13 is moved, the engagement pawl 21*a*, formed at the flexible arm 21, gradually slides over the tapered surface 16*a*, as indicated by solid lines in FIG. 3. When the slider 13 is further continued to be moved, the flexible arm 21, while being flexibly deformed, moves toward the top of the first engagement projection 16 as indicated by phantom lines.

When the female connector 2*b* is pushed as described above, the lower end of the retaining portion 27, formed at the lock arm 25, abuts against the tapered surface 37*a* of the retaining projection 37 as indicated by phantom lines in FIG. 3.

In this condition, when the female connector is further continued to be pushed, the whole of the lock arm 25 is flexibly deformed, and the retaining portion 27 slides toward the top of the retaining projection 37 as indicated by solid lines in FIG. 3. At this time, the retaining portion 27 smoothly slides since the tapered surface 37*a* is formed on the retaining projection 37, and also a tapered surface is formed at the lower side of the retaining portion 27.

When the female connector 2*b* thus continues to be pushed, the engagement pawl 21*a* of the flexible arm 21 continues to slide along the tapered surface 16*a* of the first engagement projection 16 until the rear end of the engagement pawl 21*a* is disengaged from the second engagement projection 35, as indicated by phantom lines in FIG. 4. When the rear end of the engagement pawl 21*a* is disengaged from the second engagement projection 35, the whole of the slider 13 is pushed in the fitting direction (left-hand direction in FIG. 4) by the resiliency of the spring 14, so that the engagement pawl 21*a* of the flexible arm 21 slides over the second engagement projection 35.

When the engagement pawl 21*a* reaches the rear end of the first engagement projection 16, the flexible arm 21 is restored into its initial configuration. At this time, the engagement pawl 21*a* of the flexible arm 21 moves as indicated by arrow C in FIG. 4.

When the slider 13 is moved or returned in the fitting direction, the lock arm 25 moves in unison with the slider 13. As a result, the retaining portion 27 slides over the top of the retaining projection 37, and when the lock arm 25 is restored from the flexibly-deformed condition into a flat condition, the retaining projection 37 is fitted in the retaining hole 26, thereby retaining the retaining portion 27. At this time, the male terminals 5 in the male connector 2*a* are connected respectively to the female terminals 32 in the female connector 2*b*, as shown at a lower portion of FIG. 4.

When the male connector 2*a* and the female connector 2*b* are properly fitted together, the flexible arms 21 and 22 and the lock arm 25 are restored into their respective original configurations, and a click feeling is obtained when they are retainingly engaged with the second engagement projections 35 and 36 and the retaining projection 37. If a half-fitted condition is encountered, such a click feeling is not obtained, and besides when the pushing operation is stopped, the female connector 2*b* is moved back by the resiliency of the spring 14. Therefore, whether or not the two connectors have been properly fitted together can be easily detected.

When the male connector 2*a* and the female connector 2*b* are properly fitted together as shown in FIG. 5, the second engagement projections 35 and 36 on the female connector 2*b* are engaged respectively with the inner sides of the flexible arms 21 and 22, and the tapered surfaces 21*b* and 22*b*, formed respectively on the flexible arms 21 and 22, are held in contact respectively with the tapered surfaces 35*a* and 36*a* formed respectively on the second engagement projections 35 and 36. The retaining projection 37 on the female connector 2*b* is fitted in the retaining hole 26, thereby retaining the retaining portion 27.

Therefore, in the properly-fitted condition shown in FIG. 5, even if the female connector 2*b* is pulled, the flexible arms 21 and 22 of the slider 13 are retained respectively by the second engagement projections 35 and 36, and the retaining projection 37 is retained by the retaining portion 27, thus providing the double retaining effect, so that the fitting will not be released.

Next, description will be made of a method of releasing the lock when disconnecting the male connector 2*a* and the female connector 2*b* from each other.

In this case, first, the lock release button 28 is pressed in a direction of arrow D in FIG. 5. As a result, the lock arm 25 is turned about the support portion 24 to be tilted in such a manner that the lock release button 28 is moved downward whereas the retaining portion 27 is raised as indicated by phantom lines in FIG. 4. Namely, like a seesaw, the whole of the lock arm 25 is moved on the support portion 24 serving as a fulcrum, so that the retaining engagement of the retaining portion 27 with the retaining projection 37 is released.

In this condition, since the second engagement projections 35 and 36 are still kept engaged respectively with the inner sides of the engagement pawls 21*a* and 22*a* formed respectively at the distal ends of the flexible arms 21 and 22, the female connector 2*b* will not become disengaged from the male connector. Therefore, after the locking of the retaining portion 27 on the retaining projection 37 is released, the female connector 2*b* is pulled in the disengaging direction, and as a result the flexible arms 21 and 22 are flexibly deformed outwardly (as indicated by arrows E and F in FIG. 5) respectively by the tapered surfaces 35*a* and 36*a* formed respectively on the second engagement projections 35 and 36, so that the engagement pawls 21*a* and 22*a* are disengaged respectively from the second engagement projections 35 and 36, and the female connector 2*b* is completely disengaged or disconnected from the male connector 2*a*.

As described above, in the connector 1 of this embodiment, the two connectors 2*a* and 2*b* can be easily fitted together merely by inserting and pushing the female connector 2*b* into the fitting portion 4 formed in the male connector 2*a*. In a half-fitted condition, when the fitting operation for the female connector 2*b* is released, the male connector 2*a* and the female connector 2*b* are urged away from each other by the resiliency of the spring 14, and therefore the half-fitted condition can be easily detected.

In the condition in which the male connector 2*a* and the female connector 2*b* are properly fitted together, the retaining engagement of the retaining portion 27 with the retaining projection 37 will not be released unless the lock release button 28 is depressed. Besides, even if the retaining engagement of the retaining portion 27 with the retaining projection 37 is released intentionally or accidentally, the male connector 2*a* and the female connector 2*b* will not be disengaged from each other since the flexible arms 21 and 22 are still kept engaged respectively with the second engagement projections 35 and 36.

Figure 6:
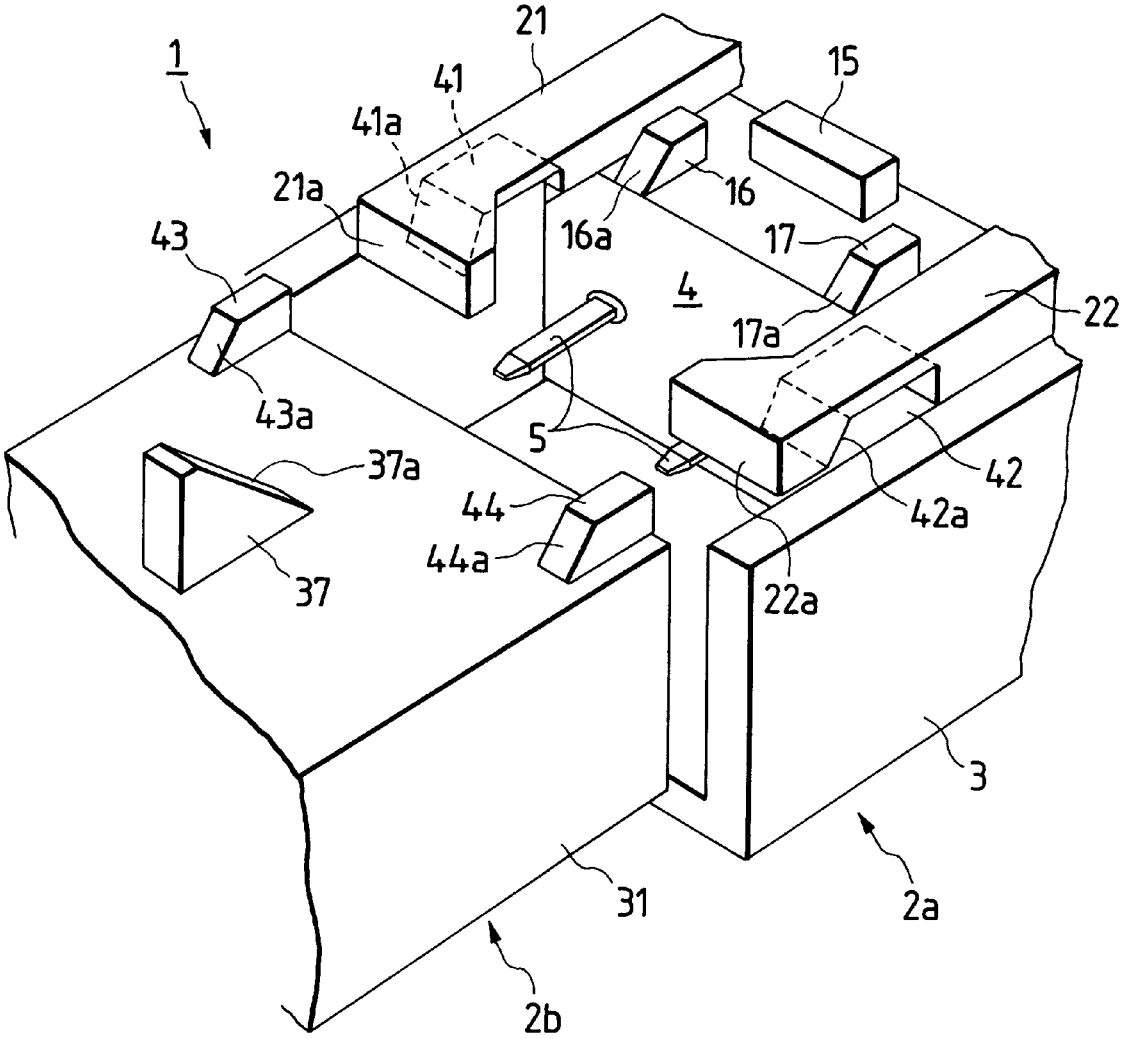
FIG. 6 is a partly-broken, perspective view of a second embodiment of the half-fitting prevention connector of the invention.
Figure 7:
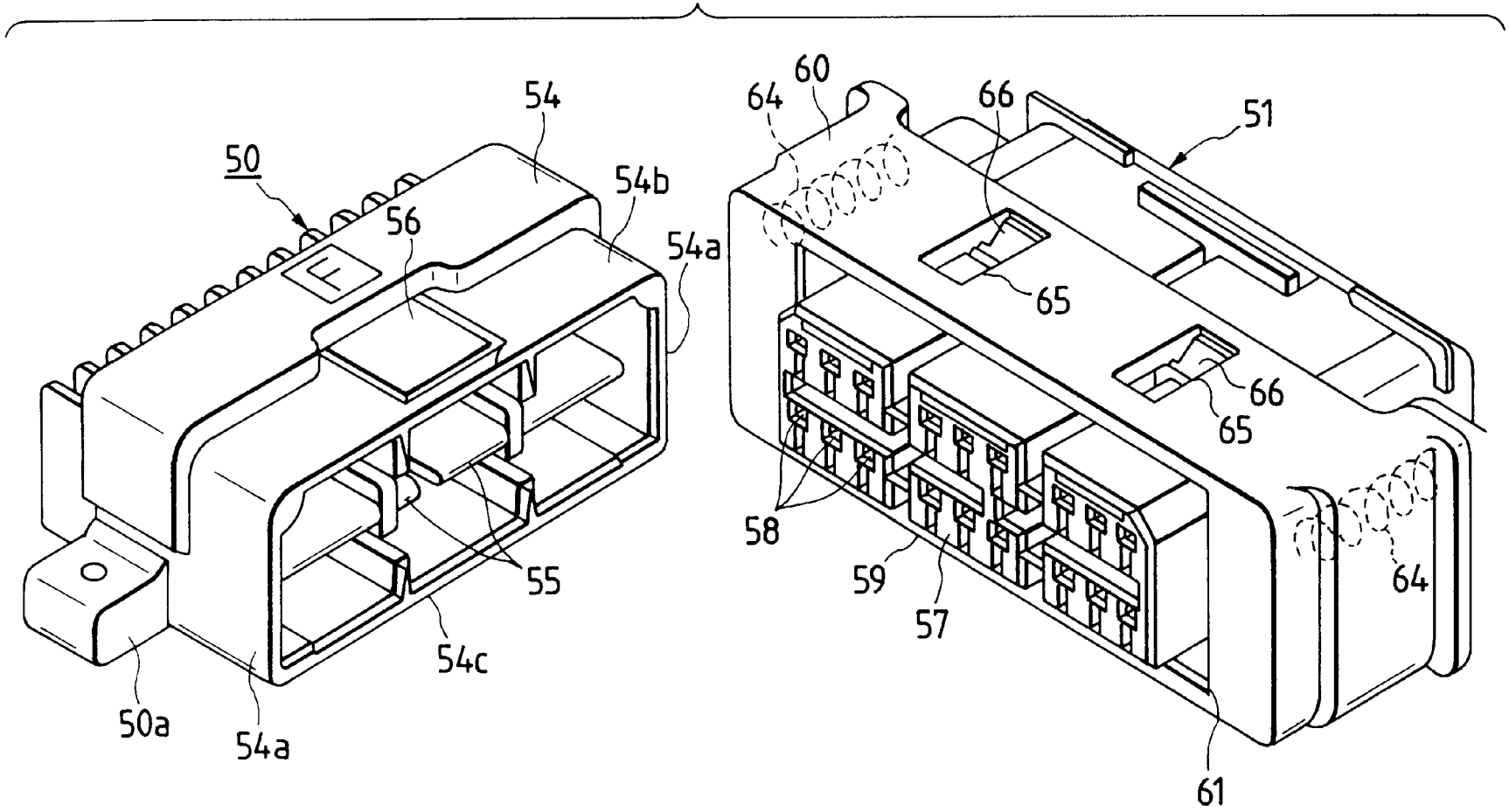
FIG. 7 PRIOR ART
FIG. 7 is a perspective view showing an example of the construction of a conventional connector.
Figure 8:
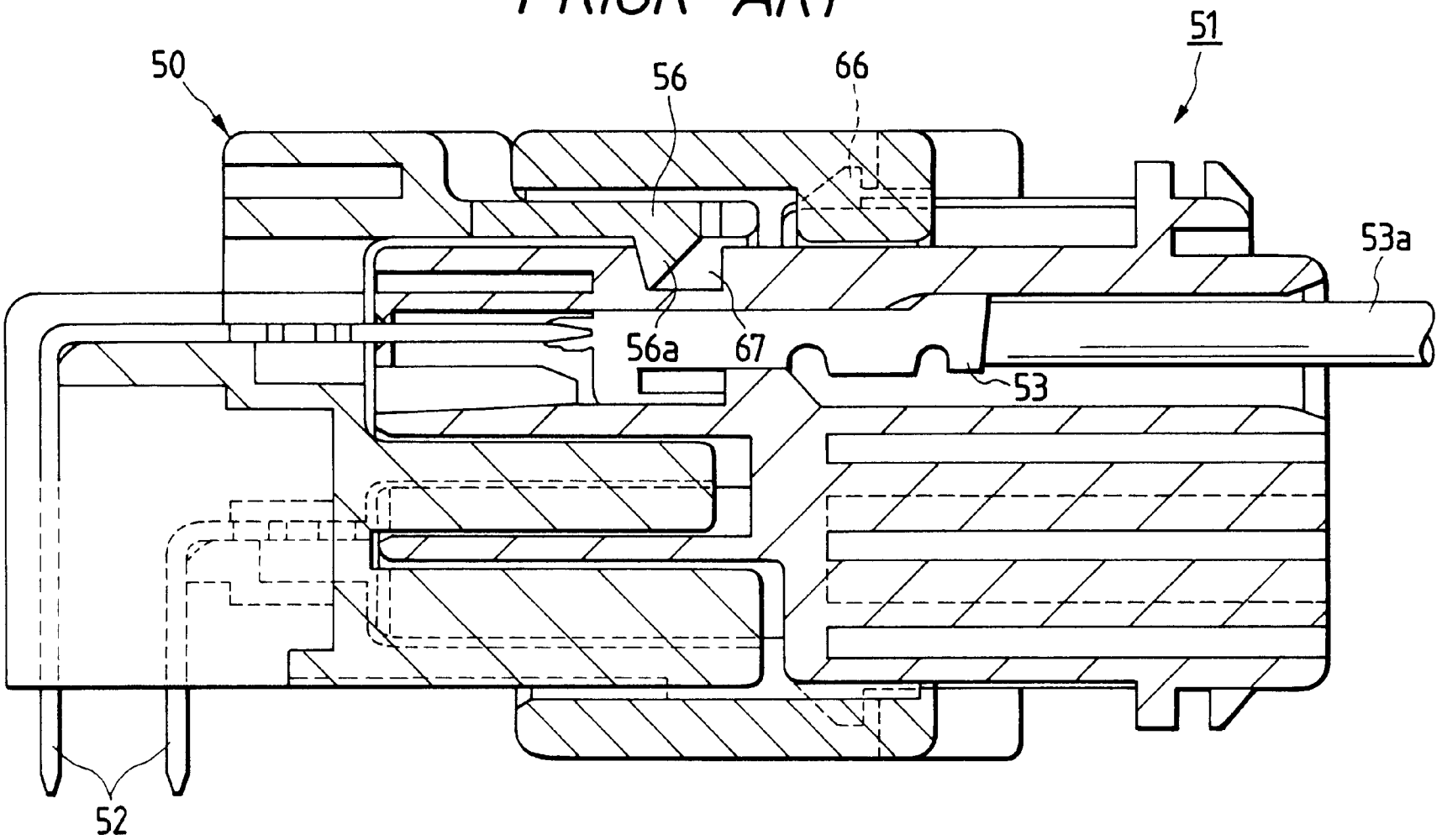
FIG. 8 PRIOR ART
FIG. 8 is a cross-sectional view of the connector of FIG. 7 in a fitted condition.

Next, a second embodiment of the half-fitting prevention connector of the present invention will be described with reference to FIG. 6. FIG. 6 is a perspective view of important portions of male and female connectors. This embodiment differs from the first embodiment in that flexible arms and second engagement projections are modified in construction. Therefore, for illustration and description purposes, those portions, having the same functions as described for the first embodiment, will be designated by identical reference numerals, respectively, whereas modified portions will be designated by different reference numerals, respectively.

In this embodiment, engagement recesses 41 and 42 are formed respectively in lower surfaces of distal end portions of flexible arms 21 and 22 formed on a male connector 2*a*. A tapered surface 41*a* or 42*a* is formed on one side surface of each of the engagement recesses 41 and 42.

Tapered surfaces 43*a* and 44*a* are formed respectively on upper sides of second engagement projections 43 and 44 on a female connector 2*b*. The engagement recesses 41 and 42 have such a size as to receive the second engagement projections 43 and 44, respectively, and the tapered surfaces 41*a* and 42*a* of the engagement recesses 41 and 42 can contact the tapered surfaces 43*a* and 44*a* of the second engagement projections 43 and 44, respectively.

The female connector 2*b* is fitted in a fitting portion 4 as in the first embodiment, and male connector terminals 5 are projected into this fitting portion 4. First engagement projections 16 and 17 are formed on a housing 3 as in the first embodiment, and a stopper 15 is also formed thereon. For better illustration of the flexible arm 21, the showing of a lock arm 25 is omitted.

In this embodiment, when fitting the male connector 2*a* and the female connector 2*b* together, the female connector 2*b* is inserted into the fitting portion 4 in the male connector 2*a*, and is further pushed as described for the preceding embodiment. As a result, the second engagement projections 43 and 44 abut respectively against engagement pawls 21*a* and 22*a* formed respectively at the distal ends of the flexible arms 21 and 22, and when the female connector 2*b* is further pushed, the engagement pawls 21*a* and 22*a* get on the first engagement projections 16 and 17, respectively.

At this time, the flexible arms 21 and 22 are flexibly deformed, and immediately when the second engagement projections 43 and 44 are disengaged respectively from the engagement pawls 21*a* and 22*a*, the flexible arms 21 and 22 are returned in the fitting direction by resiliency of a spring 14 (not shown).

Then, the second engagement projections 43 and 44 are engaged respectively in the engagement recesses 41 and 42 formed respectively in the lower surfaces of the flexible arms 21 and 22, so that the flexibly-deformed flexible arms 21 and 22 are restored into their initial configurations. In this condition, the tapered surfaces 41*a* and 42*a* of the engagement recesses 41 and 42 are held in contact with the tapered surfaces 43*a* and 44*a* of the second engagement projections 43 and 44, respectively. Although not shown in the drawings, the lock arm 25 is retained on a retaining projection 37 at the same time, and the fitting between the male connector 2*a* and the female connector 2*b* is completed.

In this embodiment, also, in a half-fitted condition, the female connector 2*b* is pushed back, and therefore the half-fitted condition is prevented. Besides, the second engagement projections 43 and 44 are engaged respectively in the engagement recesses 41 and 42, and therefore even if the retaining engagement of the lock arm 25 with the retaining projection 37 is released, the fitting between the two connectors will not be released, and there can be provided the connector of high reliability.

As described above, in the half-fitting prevention connector, the slider is mounted on the housing, and is normally urged in one direction by the resiliency of the resilient member, and is moved in the direction opposite to the direction of urging by the resilient member when the mating connector is fitted, and the slider includes the lock arm which can be pivotally moved in accordance with the fitting of the mating connector, and has the retaining portion which is retained by the retaining projection, formed on the mating connector, in accordance with the fitting of the mating connector, and the slider further includes the flexible arms each of which is flexibly deformed by the associated first engagement projection formed on the housing, and is engaged with the associated second engagement projection, formed on the mating connector, in accordance with the fitting of the mating connector.

The inwardly-directed engagement pawl is formed at the distal end of each of the flexible arms, and the tapered surface is formed on the inner side of the engagement pawl.

The tapered surface for abutting engagement with the inner edge of the engagement pawl of the flexible arm is formed on the front end surface of the first engagement projection.

The tapered surface, corresponding to the tapered surface of the engagement pawl, is formed on the rear end surface of the second engagement projection.

Therefore, when the female and male connectors are to be fitted together, the flexible arms are pushed respectively by the second engagement projections formed on the female connector, and are caused to get respectively on the first engagement projections formed on the housing of the male connector, and as a result the flexible arms are flexibly deformed, and are disengaged respectively from the second engagement projections. Then, the flexible arms are returned together with slider under the influence of the spring, and slide respectively over the second engagement projections, and the retaining portions, formed respectively at their distal ends, are engaged with the second engagement projections, respectively. In accordance with the returning movement of the slider, the lock arm is retained by the retaining projection formed on the housing of the female connector, so that the female and male connectors are retained relative to each other in a double manner.

Therefore, the female and male connectors can be quite easily fitted together merely by aligning the two connectors with each other and then by pushing them toward each other. Besides, if this pushing operation is stopped in a half-fitted condition, the female connector is pushed back by the resiliency of the spring, and therefore the half-fitted condition can be easily detected.

The lock arm is pivotally mounted, and therefore by pivotally moving the lock arm intentionally, for example, by the finger, the retaining engagement of the lock arm with the retaining projection can be released. In this condition, the flexible arms are stilled kept engaged respectively with the second engagement projections, and therefore the male and female connectors are prevented from being accidentally disengaged from each other.

What is claimed is:

1. A half-fitting prevention connector, comprising:

a first connector which is to be fitted to a second connector, said first connector including a first projection;

a slider mounted on said first connector for movement in a fitting direction and a retracting direction; and a resilient member provided on said first connector for urging said slider in said fitting direction;

wherein, when said first connector is fitted to said second connector, (1) said second connector moves said slider in said retracting direction against the influence of said resilient member, and (2) said first projection elastically deflects said slider.

2. The half-fitting prevention connector according to claim 1, wherein said slider comprises a flexible arm which is elastically deflectable;

wherein, when said first connector is fitted to said second connector, (1) a second projection of said second connector abuts said flexible arm and moves said slider in said retracting direction against the influence of said resilient member, (2) while said slider moves in said retracting direction, said first projection of said first connector elastically deflects said flexible arm to align said flexible arm with respect to said second projection, and (3) said resilient member moves said slider in said fitting direction, such that said flexible arm retains said second projection of said second connector.

3. The half-fitting prevention connector according to claim 2, wherein said flexible arm includes an inwardly-directed engagement pawl formed at a distal end thereof, said engagement pawl having a tapered surface formed on an inner side thereof.

4. The half-fitting prevention connector according to claim 3, wherein said first projection includes a tapered surface upon which said engagement pawl of said flexible arm slides to elastically deflect said flexible arm.

5. The half-fitting prevention connector according to claim 3, wherein, when said flexible arm retains said second projection, said tapered surface of said engagement pawl abuts against a corresponding tapered surface provided on a surface of said second projection.

6. The half-fitting prevention connector according to claim 1, wherein said slider comprises a pivotally moveable lock arm having a retaining portion;

wherein, when said first connector is fitted to said second connector, a retaining projection of said second connector pivots said lock arm, such that said retaining portion retains said retaining projection.

* * * * *